US009119452B1

(12) United States Patent
Lai

(10) Patent No.: US 9,119,452 B1
(45) Date of Patent: Sep. 1, 2015

(54) HANDLE STRUCTURE FOR A DRAW BAR OF A LUGGAGE CASE

(71) Applicant: Wei-Hung Lai, Taichung (TW)

(72) Inventor: Wei-Hung Lai, Taichung (TW)

( * ) Notice: Subject to any disclaimer, the term of this patent is extended or adjusted under 35 U.S.C. 154(b) by 0 days.

(21) Appl. No.: 14/214,465

(22) Filed: Mar. 14, 2014

(51) Int. Cl.
*A45C 13/26* (2006.01)
*B25G 1/04* (2006.01)

(52) U.S. Cl.
CPC ..... *A45C 13/262* (2013.01); *B25G 1/04* (2013.01); *Y10T 16/4554* (2015.01)

(58) Field of Classification Search
CPC . Y10T 16/451; Y10T 16/4554; Y10T 16/473; A45C 13/26; A45C 13/262; A45C 13/265; A45C 13/267; B25G 1/04; B62B 1/125; B62B 5/067
USPC ..... 16/113.1, 405, 427; 190/18 A, 115; 280/655.1, 47.371
See application file for complete search history.

(56) References Cited

U.S. PATENT DOCUMENTS 5,502,876 A * 4/1996 Wang ..... 16/113.1
5,581,846 A * 12/1996 Wang ..... 16/113.1
6,061,871 A * 5/2000 Wang ..... 16/113.1
6,122,800 A * 9/2000 Cheng ..... 16/113.1
6,434,790 B1 * 8/2002 Chen ..... 16/113.1
6,591,951 B1 * 7/2003 Chen ..... 190/115
6,776,271 B2 * 8/2004 Chen ..... 190/18 A
6,920,666 B1 * 7/2005 Chen ..... 16/113.1
7,191,878 B2 * 3/2007 Lu ..... 190/115
7,232,019 B2 * 6/2007 Chang et al. ..... 190/115
7,467,696 B2 * 12/2008 Wu ..... 190/115
2004/0031654 A1 * 2/2004 Chang ..... 190/18 A

* cited by examiner

*Primary Examiner* — William Miller
(74) *Attorney, Agent, or Firm* — Patent Office of Bang Shia

(57) ABSTRACT

A handle structure for a draw bar of a luggage case includes a handle, a handle casing, a push member, and a connecting device. The handle includes two control members each having a movable member pivoted to a stationary member. The movable member includes a press portion and a reaction portion at two sides of the pivot point. The handle casing is fixed around the handle to hold the press portion. The push member has a head portion disposed in the handle casing and connected to the reaction portions, and a shaft portion extending out of the handle casing. The connecting device is fixed to the rod portion, and the shaft portion is inserted in the connecting device. When the press portion is subjected to a force in a direction, the reaction portion is moved toward that direction, the reaction portion moves the shaft portion toward the rod portion.

6 Claims, 7 Drawing Sheets

HANDLE STRUCTURE FOR A DRAW BAR OF A LUGGAGE CASE

BACKGROUND OF THE INVENTION

1. Field of the Invention

The present invention relates to a draw bar of a luggage case, and more particularly to a handle structure for a draw bar of a luggage case.

2. Description of the Prior Art

Luggage cases are mostly provided with a draw bar to be pulled by a user, and the draw bar is usually retractile. As shown in FIG. 1, a conventional luggage case 10 comprises a draw bar 11. The draw bar 11 includes a rod portion 12 which and a handle 13 disposed at the end of the rod portion 12. On the handle 13 is provided a press button 14.

The luggage case needs to be put away when not in use, so the rod portion 12 of the draw bar 11 can be pushed into the luggage case 10 and locked therein, which not only saves storage space, but also prevent rupture of the draw bar 11 caused by unexpected collision. The draw bar 11 can also be automatically extended out of the luggage case 10 by pressing the press button 14, so that the user can tow the luggage case.

It is to be noted that the draw bar should be pushed back into the luggage case for luggage check in. However, the draw bar would be projected out of the luggage case when the press button is touched by accident, which is likely to cause rupture.

To solve this problem, some of the luggage cases are provided with a protection cover to cover the press button, so as to prevent the press button from being pressed by accident. However, this also makes the luggage case inconvenient to use, since it has to push the protection cover back and forth between the covered and uncover positions, every time the draw bar needs to be pulled out or pushed into the luggage case.

The present invention has arisen to mitigate and/or obviate the afore-described disadvantages.

SUMMARY OF THE INVENTION

The primary objective of the present invention is to provide a handle structure for a draw bar of a luggage case, wherein the possibility that the draw bar will automatically pop out of the luggage case when the press portion is accidentally pressed can be prevented.

To achieve the above objective, a handle structure for a draw bar of a luggage case, the draw bar comprises a rod portion which is capable of sliding in and out of the luggage case, and the handle structure comprises a handle, a handle casing, a push member, and a connecting device. The handle is provided with two control members, each of control members includes a movable member which is pivoted to a stationary member via a pivot point, each of the movable members includes a press portion and a reaction portion which are located at two sides of the pivot point. The handle casing is fixed around a periphery of the handle and defines a press space to hold the press portions of the handle, and the press space is formed with an open end at the handle casing. The push member includes a head portion and a shaft portion, the head portion is disposed in the handle casing and connected to the reaction portions, and the shaft portion extends out of the handle casing. The connecting device has one end fixed to the rod portion of the luggage case, and the shaft portion of the push member is inserted in another end of the connecting device. When the press portion is subjected to a force in a direction, the corresponding reaction portion of the movable member will be moved toward that direction, meanwhile the reaction portion will push the push member to move the shaft portion toward the rod portion of the draw bar of the luggage casing.

The handle structure for the draw bar of the luggage case in accordance with the present invention offers the following advantages: 1. the handle casing protects the handle of the draw bar from unexpectedly popping out of the luggage case. 2. The handle is able to pivot with respect to the luggage case, allowing the user to tow at a comfortable angle. 3. The present invention is provided with two control members, therefore, any user who is left or right handed can easily handle one of the control members with one hand.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
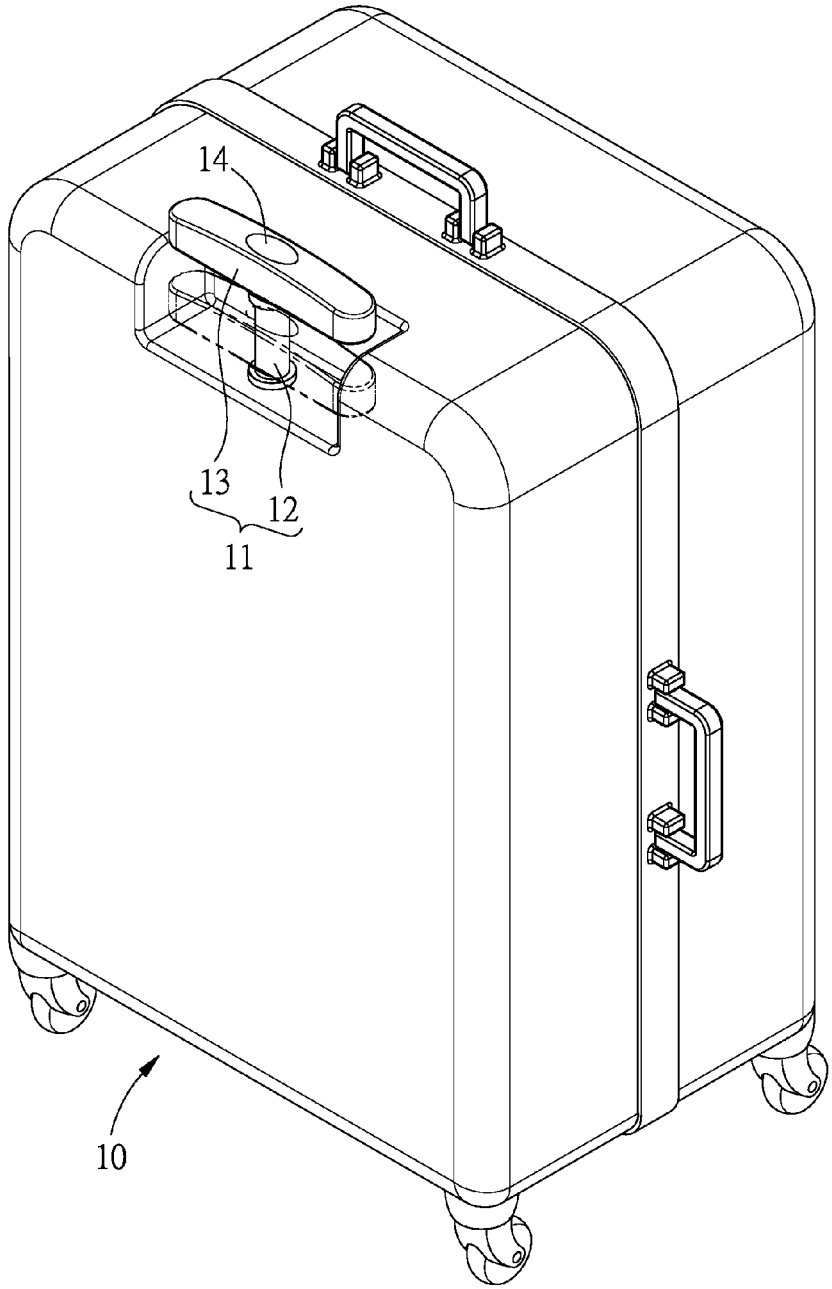
FIG.1 PRIOR ART
FIG. 1 shows a conventional luggage case with a draw bar.
Figure 2:
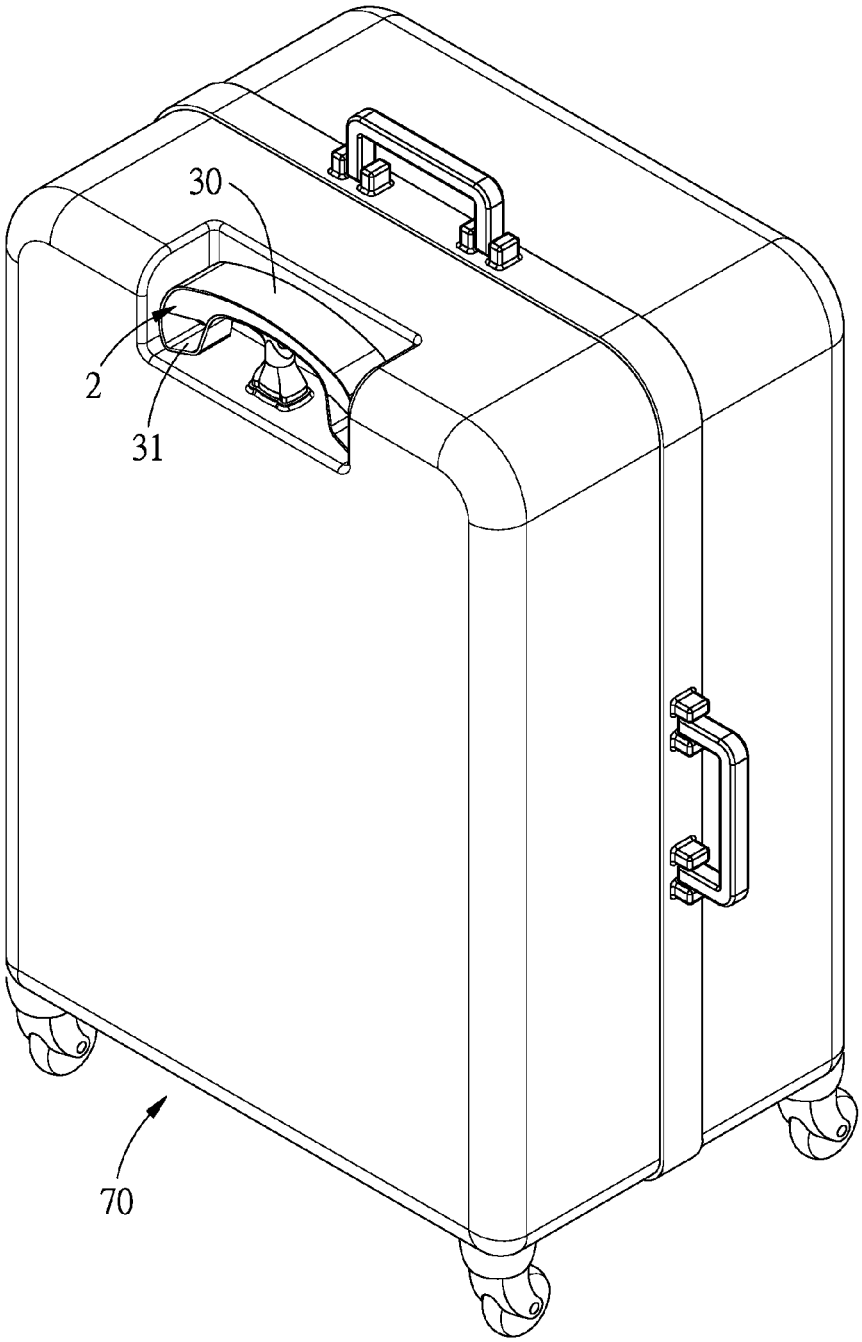
FIG. 2 shows a luggage case with a draw bar in accordance with a preferred embodiment of the present invention.
Figure 3:
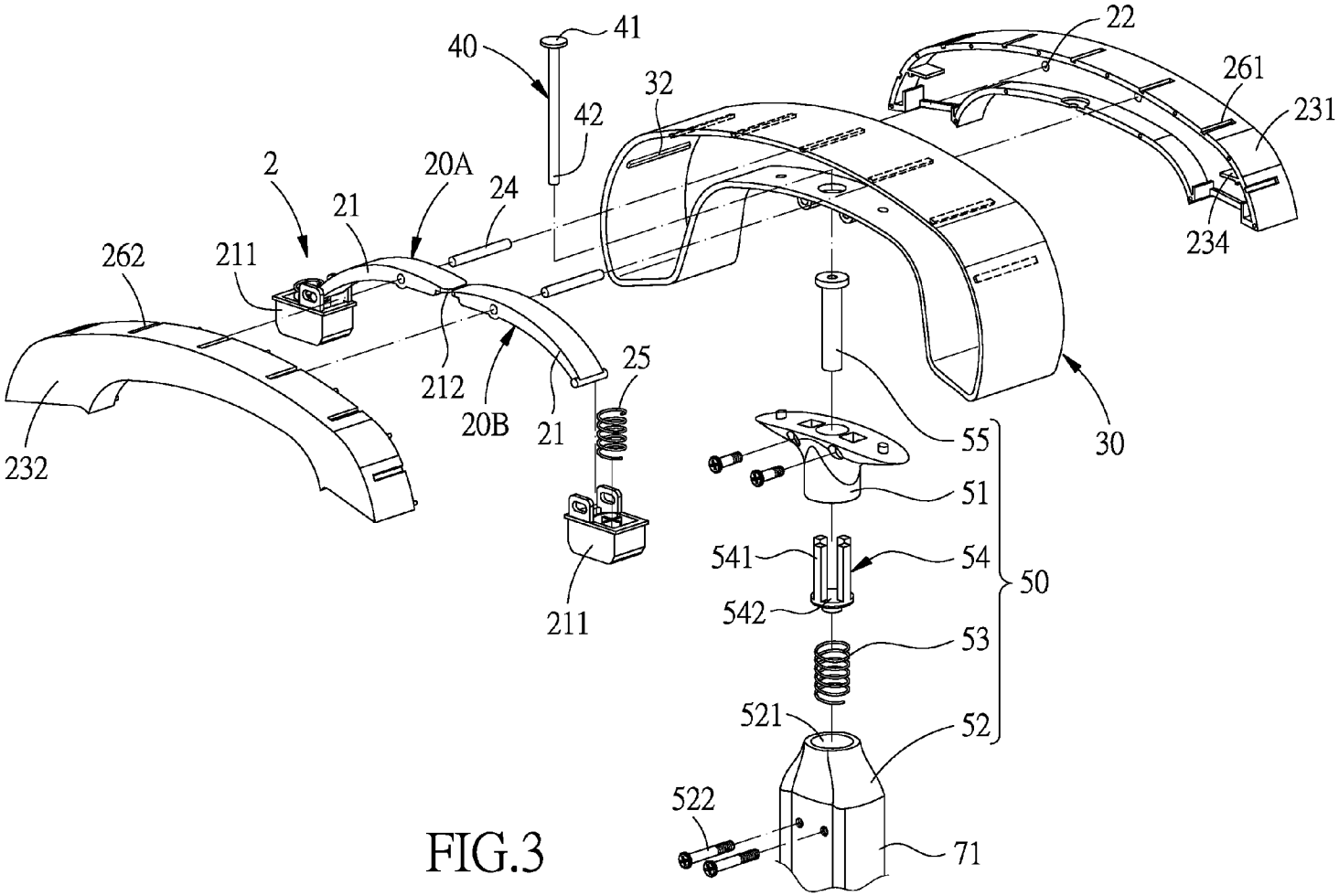
FIG. 3 is an exploded view of a handle structure for the draw bar of the luggage case in accordance with the present invention.
Figure 4:
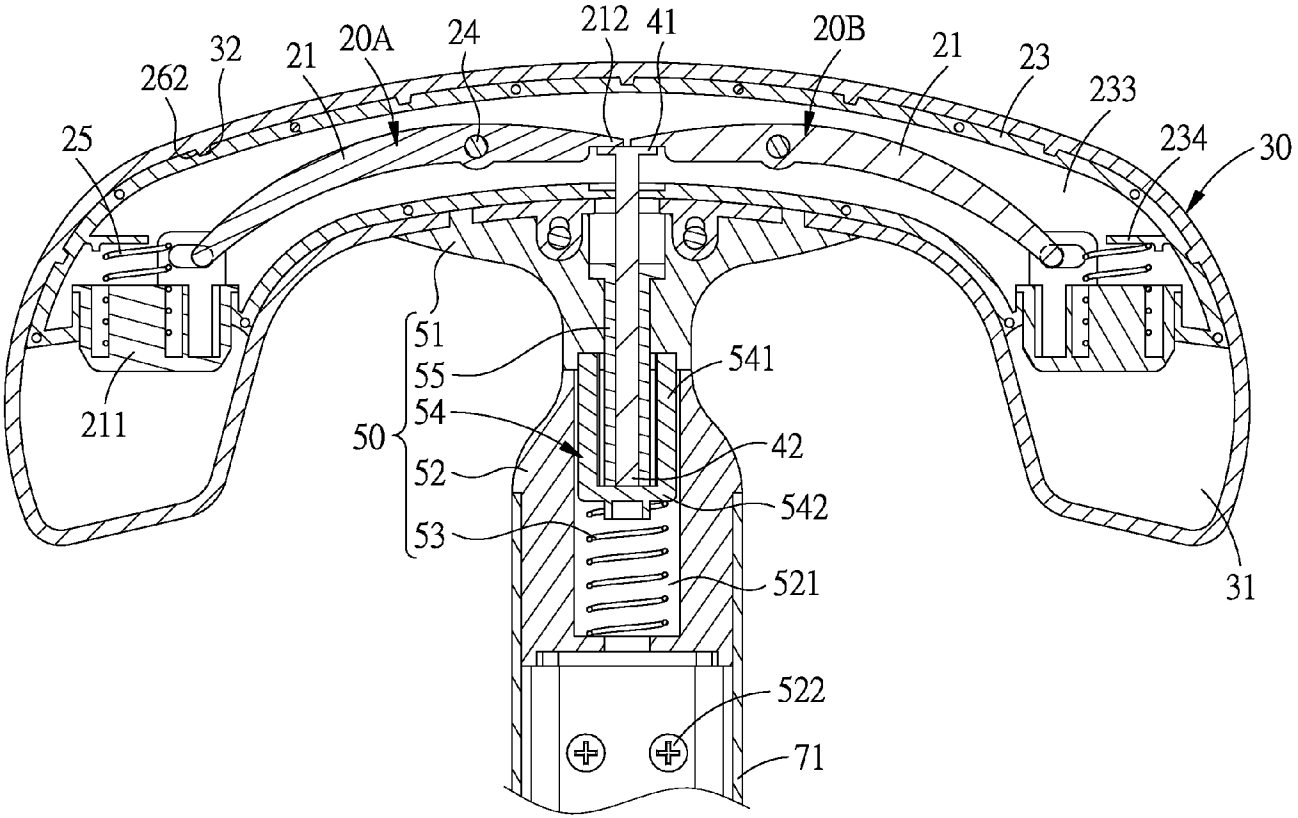
FIG. 4 is a cross sectional view of the handle structure for the draw bar of the luggage case in accordance with the present invention.
Figure 5:
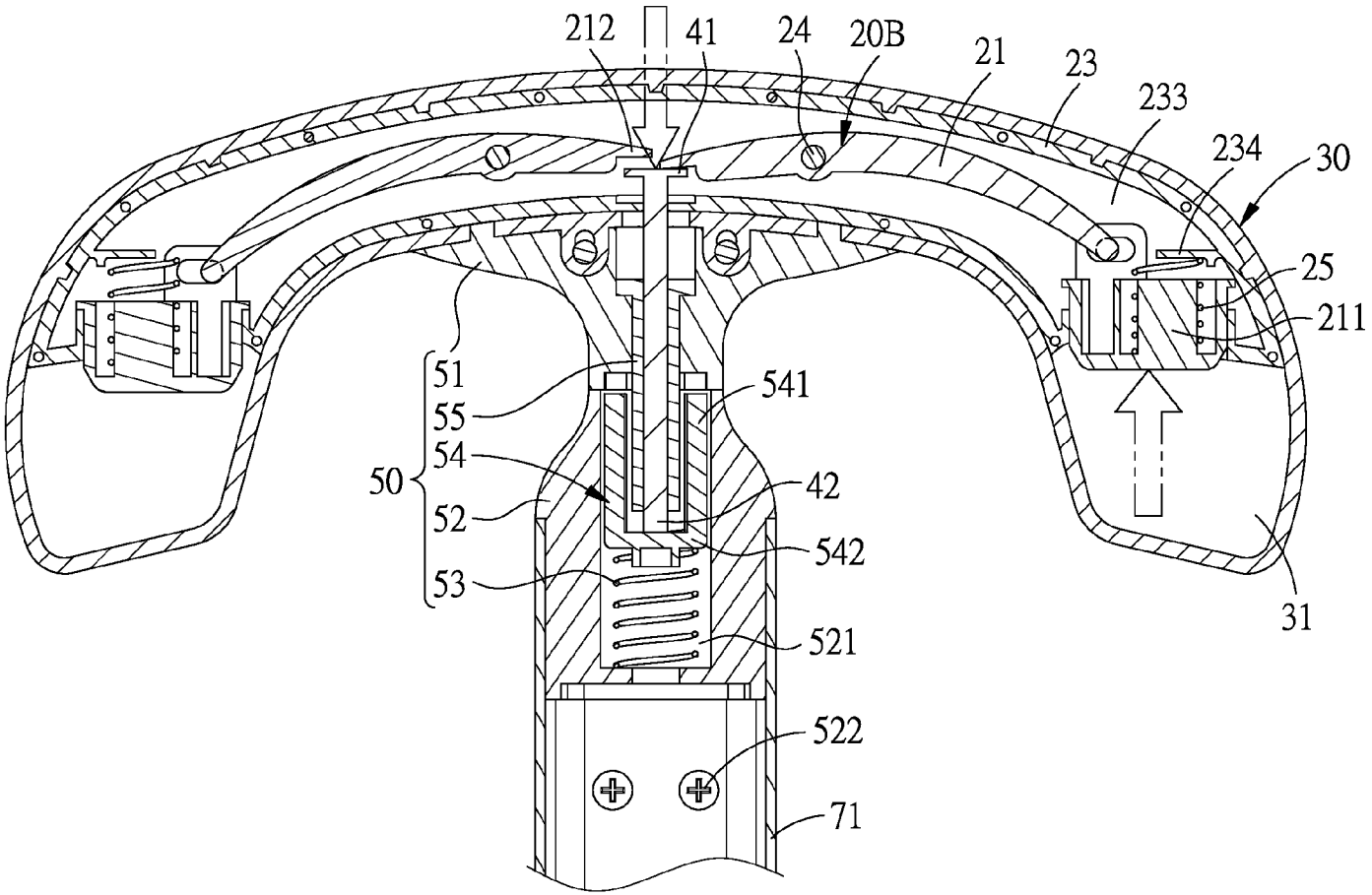
FIG. 5 is a cross sectional view of the handle structure for the draw bar of the luggage case in accordance with the present invention, wherein the press portion is pressed.

Referring to FIGS. 2-4, a handle structure for a draw bar of a luggage case 70 in accordance with a preferred embodiment of the present invention is shown, and the draw bar comprises a rod portion 71 which is capable of sliding in and out of the luggage case 70. The handle structure comprises: a handle 2, a handle casing 30, a push member 40, and a connecting device 50.

The handle 2 includes two control members 20A and 20B, each of which includes a movable member 21 which is pivoted to a stationary member 23 via a pivot point 22. In this embodiment, the stationary member 23 includes a first cover member 231 and a second cover member 232 which are assembled together to define an inner space 233. Each of the movable members 21 is pivoted to the first cover member 231 and disposed in the inner space 233, and the pivot point 22 is a pivot 24. Each of the movable members 21 includes a press portion 211 and a reaction portion 212 which are located at two sides of the pivot point 22. The movable member 21 is an elongated arc-shaped structure, the reaction portion 212 is located at one end of the movable member 21, and the press portion 211 is a press button pivotally located at another end of the movable member 21. The press portion 211 further includes a first elastic member 25, and the first cover member is provided with two ribs 234 which are located close to the press portion 211 of each of the movable members 21. The first elastic member 25 has two ends pressed against the press portion 211 and the ribs 234. The first elastic member 25 will be compressed when the press portion 211 is pressed, and will push the press portion 211 back to its original position when the press portion 211 is not pressed.

The handle casing 30 surrounds the periphery of the handle 2 and defines a press space 31 to hold the press portions 211 of the handle 2, and the press space 31 is formed with an open end at the handle casing 30. In this embodiment, the handle casing 30 has a plurality of engaging ribs 32 engaged with a plurality of engaging grooves 261, 262 which are formed on the first and second cover members 231, 232, so that the handle casing 30 is fixed to the periphery of the handle 2.

The push member 40 includes a head portion 41 and a shaft portion 42. The head portion 41 is disposed in the inner space 233 of the stationary members 23 of the handle 2 and connected to the reaction portions 212. The shaft portion 42 extends out of the handle casing 30. In this embodiment, the head portion 41 is a flat and abutted against the reaction portions 212.

The connecting device 50 has one end fixed to the rod portion 71 of the luggage case 70, and the shaft portion 42 of the push member 40 is inserted in another end of the connecting device 50. The connecting device 50 includes a connecting member 51 and a pivot member 52 pivotally locked to the connecting member 51 by an engaging member 55. The pivot member 52 is fixed to the luggage case 70 by two bolts 522. The connecting member 51 has one end fixed to the handle casing 30, and another end formed with a plurality of positioning grooves 511. One end of the pivot member 52 is fixed to the rod portion 71 of the luggage case 70, at the center of the pivot member 52 is formed a receiving cavity 521 in which are disposed a second elastic member 53 and an engaging member 54. The second elastic member 53 has one end disposed at the bottom of the receiving cavity 521 and has another end connected to one end of the engaging member 54. Another end of the engaging member 54 is formed with a positioning pin 541 and a stop portion 542. The positioning pin 541 is disposed in the positioning grooves 511, and the shaft portion 42 of the push member 40 is inserted through the engaging member 55 and the connecting member 51 and stopped against the stop portion 542.

When the press portion 211 is subjected to a force in a direction, the corresponding reaction portion 212 of the movable member 21 will be moved toward that direction, meanwhile the reaction portion 212 will push the push member 40 to move the shaft portion 42 toward the rod portion 71 of the draw bar of the luggage casing 70.

What mentioned above are the steps of the preferred embodiment of the present invention, for a better understanding of the invention, its operating advantages and the specific objects attained by its uses, reference should be had to the following descriptive matter and FIGS. 2-5. Hereafter only one control member is described for easy explanation, when the user inserts finger into the press space 31 of the handle casing 30 and presses the press portion 211, the press portion 211 will move upward to compress the first elastic member 25. Meanwhile, the movable member 21 is pushed by the press portion 211 to pivot around the pivot 24. The reaction portion 212 of the movable member 21 consequently moves downward to push the head portion 41 of the push member 40, so that the shaft portion 42 of the push member 40 pushes the engaging member 54 downward to release the rod portion 71 of the luggage case 70 from locking position, allowing the rod portion 71 to retract downward or extend upward. Unlocking the rod portion 71 with the downward movement of the engaging member 54 is of conventional art, therefore, further explanation would be omitted. Once the user's finger is released from the press portion 211, the press portion 211 will be pushed back to its original position by the first elastic member 25.

The present invention is provided with two control members 20A, 20B, therefore, any user who is left or right handed can easily handle one of the control members with one hand.

It is to be noted that the hand casing 30 is fixed around the periphery of the handle 2 of the luggage case 70, and defines a press space 31 to hold the press portion 211 of the handle 2, so that the possibility that the handle 2 and the rod portion 71 will automatically extend out of the luggage case when the press portion 211 is accidentally pressed can be prevented. Besides, the user can insert a finger into the press space 31 to operate the control member 20, without using any extra safety devices, such as the conventional protection cover, which makes the draw bar of the present invention easy to handle.

Figure 6C:
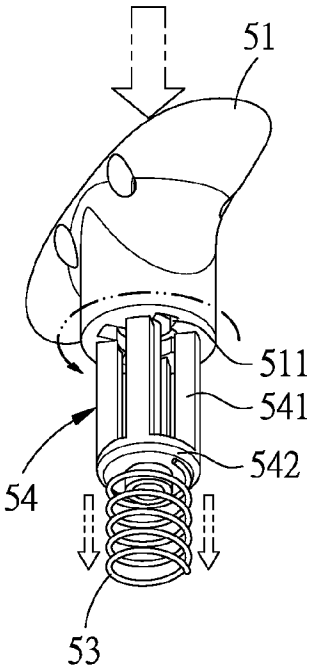
FIG. 6C shows that the pivot member of the handle structure for the draw bar of the luggage case in accordance with the present invention is turned an angle with respect to the connecting member.
Figure 6B:
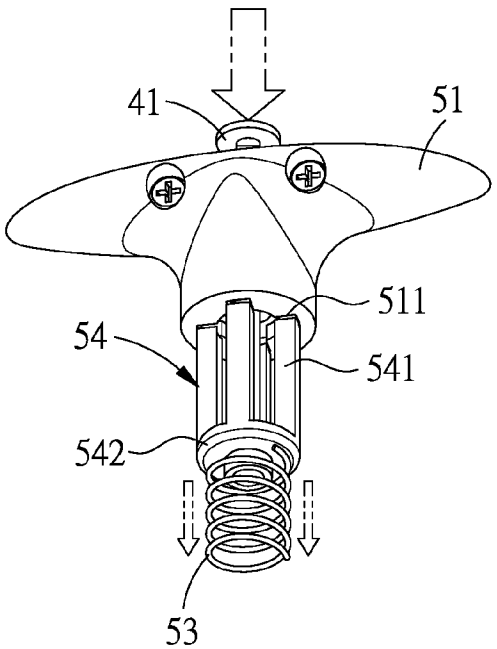
FIG. 6B shows that the head portion of the push member of the handle structure for the draw bar in accordance with the present invention being pressed.
Figure 6A:
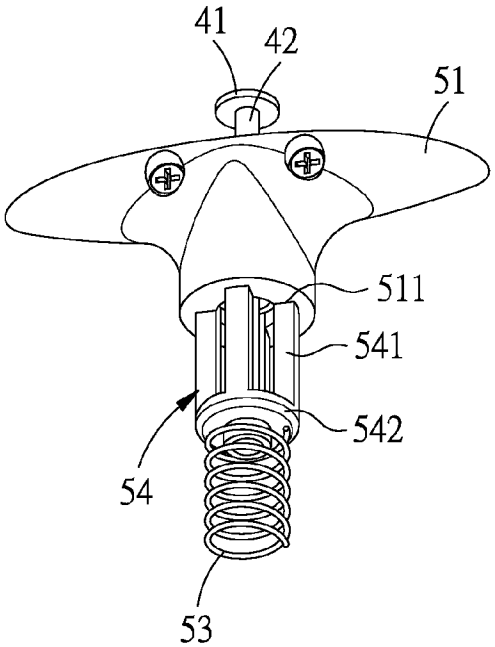
FIG. 6A shows the initial position of the connecting member of the handle structure for the draw bar of the luggage case in accordance with the present invention.

Referring then to FIGS. 6A, 6B and 6C, the connecting member 51 is able to pivot with respect to the pivot member 52, which allows the user to tow the luggage case 70 at a comfortable angle. FIG. 6A shows the initial position of the connecting member 51. Then, as shown in FIG. 6B, the user can press the press portion 211 to push the shaft portion 42 of the push member 40 downward, meanwhile, the stop portion 542 of the engaging member 54 pushes the engaging member 54 to move downward, so as to release the positioning pin 541 of the engaging member 54 from the positioning grooves 511, while the second elastic member 53 is compressed. Then, as shown in FIG. 6C, the user can rotate the connecting member 51 around the pivot member 52 to adjust his hand to a comfortable angle, once the angle adjustment is done, the user releases the press portion 211, the positioning pin 541 of the engaging member 54 will be pushed by the second elastic member 53 back into the positioning grooves 511 again.

Figure 7:
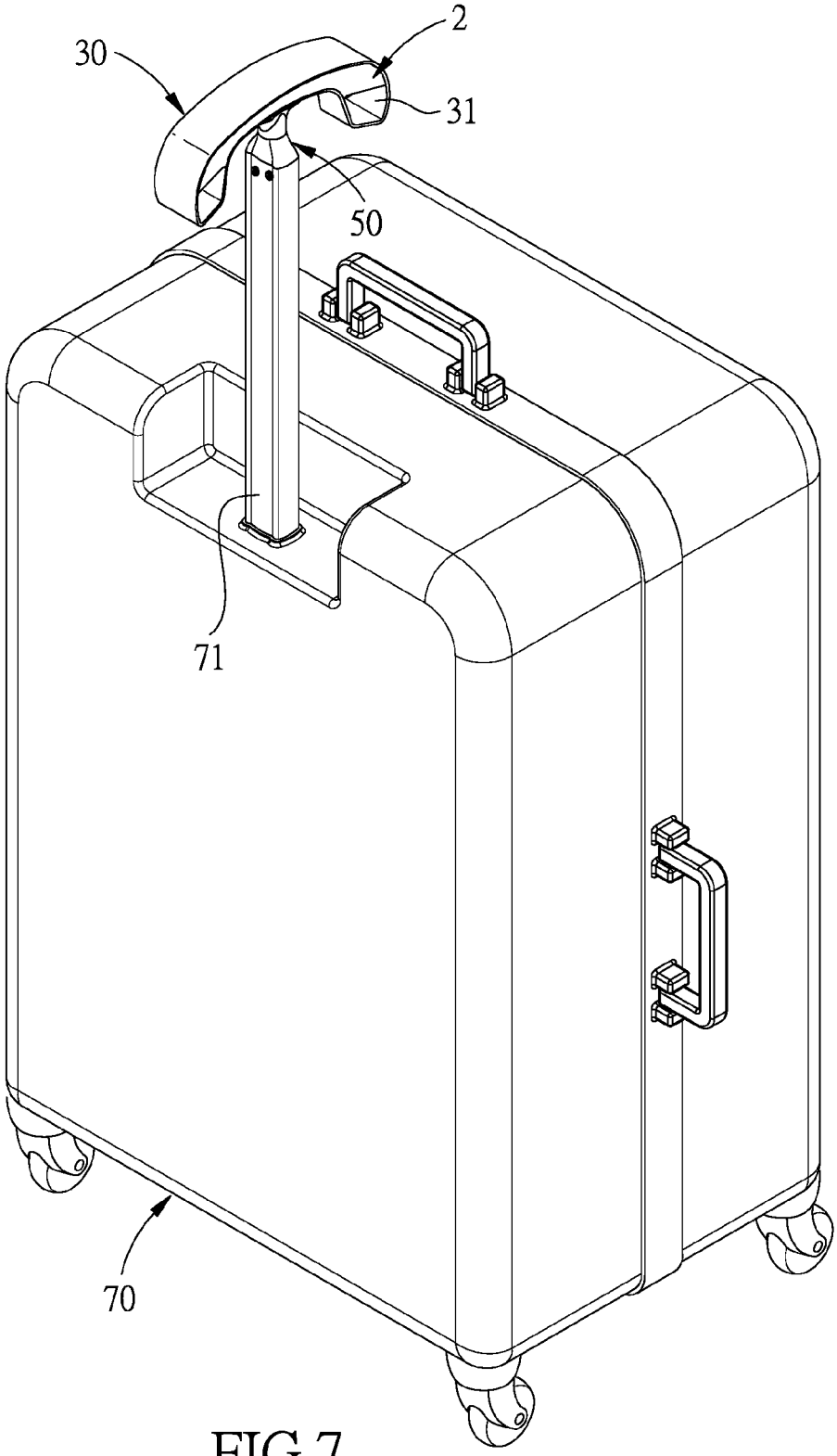
FIG. 7 shows a luggage case with a draw bar in accordance with the present invention, wherein the draw bar is pulled out of the luggage case.

Referring then to FIG. 7, the handle structure for the draw bar of the luggage case 70 in accordance with the present invention offers the following advantages: 1. the handle casing protects the handle of the draw bar from unexpectedly popping out of the luggage case. 2. The handle is able to pivot with respect to the luggage case, allowing the user to tow at a comfortable angle. 3. The present invention is provided with two control members 20A, 20B, therefore, any user who is left or right handed can easily handle one of the control members with one hand.

While we have shown and described various embodiments in accordance with the present invention, it is clear to those skilled in the art that further embodiments may be made without departing from the scope of the present invention.

What is claimed is:

1. A handle structure for a draw bar of a luggage case, the draw bar comprising a rod portion which is capable of sliding in and out of the luggage case, and the handle structure comprising:

a handle with two control members, each of control members including a movable member which is pivoted to a stationary member via a pivot point, each of the movable members including a press portion and a reaction portion which are located at two opposing sides of the pivot point;

a handle casing fixed around a periphery of the handle and defining a press space to hold the press portions of the handle therein, and portions of the press space adjacent to and below the press portions being open to the exterior of the handle casing for insertion of a user's finger;

a push member including a head portion and a shaft portion, the head portion being disposed in the handle casing and connected to the reaction portions, the shaft portion extending out of the handle casing; and a connecting device having one end fixed to the rod portion of the luggage case, and the shaft portion of the push member being inserted in another end of the connecting device;

when the press portion is subjected to a force in a direction, the corresponding reaction portion of the movable member will be moved toward that direction, meanwhile the reaction portion will push the push member to move the shaft portion toward the rod portion of the draw bar of the luggage casing.

2. The handle structure for the draw bar of the luggage case as claimed in claim 1, wherein the stationary member includes a first cover member and a second cover member, and the movable members are pivoted to the first cover member.

3. The handle structure for the draw bar of the luggage case as claimed in claim 2, wherein the movable member is an elongated arc-shaped structure, the reaction portion is located at one end of the movable member, and the press portion is a press button pivotally located at another end of the movable member.

4. The handle structure for the draw bar of the luggage case as claimed in claim 3, wherein the press portion further includes a first elastic member, the first cover member is provided with two ribs which are located close to the press portion of each of the movable members, the first elastic member has two ends pressed against the press portion and the ribs, the first elastic member will be compressed when the press portion is pressed, and will push the press portion back to its original position when the press portion is not pressed.

5. The handle structure for the draw bar of the luggage case as claimed in claim 1, wherein the connecting device includes a connecting member and a pivot member pivotally locked to the connecting member, the connecting member has one end fixed to the handle casing, and one end of the pivot member is fixed to the rod portion of the luggage case.

6. The handle structure for the draw bar of the luggage case as claimed in claim 5, wherein another end of the connecting member is formed with a plurality of positioning grooves, at the center of the pivot member is formed a receiving cavity in which are disposed a second elastic member and an engaging member, the second elastic member has one end disposed at a bottom of the receiving cavity and has another end connected to one end of the engaging member, another end of the engaging member is formed with a positioning pin and a stop portion, the positioning pin is disposed in the positioning grooves, and the shaft portion of the push member is stopped against the stop portion.

* * * * *